US008905622B2

(12) United States Patent
Anderson et al.

(10) Patent No.: US 8,905,622 B2
(45) Date of Patent: Dec. 9, 2014

(54) ERGONOMIC PORTABLE MIXING APPARATUS

(75) Inventors: Edward Charles Anderson, Bokeelia, FL (US); Edward Cornelius Anderson, Bokeelia, FL (US)

(73) Assignee: Anderson Tool Corporation, Bokeelia, FL (US)

( * ) Notice: Subject to any disclaimer, the term of this patent is extended or adjusted under 35 U.S.C. 154(b) by 968 days.

(21) Appl. No.: 13/028,515

(22) Filed: Feb. 16, 2011

(65) Prior Publication Data

US 2011/0211419 A1 Sep. 1, 2011

Related U.S. Application Data

(60) Provisional application No. 61/338,958, filed on Feb. 26, 2010.

(51) Int. Cl.

| | |
|---|---|
| ***B01F 7/18*** | (2006.01) |
| ***B01F 7/32*** | (2006.01) |
| ***B01F 13/00*** | (2006.01) |
| ***B01F 7/00*** | (2006.01) |

(52) U.S. Cl.

CPC ..... *B01F 7/00583* (2013.01); *B01F 13/0028* (2013.01)

USPC ..... 366/65; 366/129; 366/325.4; 366/325.8; 366/325.93; 366/328.4; 366/343

(58) Field of Classification Search

USPC ..... 366/64, 65, 129, 325.4, 325.8, 325.93, 366/328.1, 328.2, 328.4, 343

See application file for complete search history.

(56) References Cited

U.S. PATENT DOCUMENTS

| | | | | |
|---|---|---|---|---|
| 3,031,273 | A * | 4/1962 | Latinen | 366/328.1 |
| 4,065,107 | A * | 12/1977 | Van Horbek | 366/343 |
| 4,175,875 | A * | 11/1979 | Van Horbek | 366/343 |
| 4,312,596 | A * | 1/1982 | Maezawa et al. | 366/343 |
| 4,692,029 | A * | 9/1987 | Davis | 366/149 |
| 4,844,355 | A * | 7/1989 | Kemp et al. | 241/172 |
| 5,030,011 | A * | 7/1991 | Kronberg | 366/279 |
| 5,470,148 | A | 11/1995 | Gorr et al. | |
| 5,951,162 | A * | 9/1999 | Weetman et al. | 366/328.1 |
| 6,331,071 | B2 * | 12/2001 | Akamine et al. | 366/325.92 |
| 7,553,065 | B2 * | 6/2009 | King | 366/129 |
| 7,967,497 | B2 * | 6/2011 | Whitney | 366/129 |
| 2008/0075817 | A1 * | 3/2008 | Backus et al. | 426/389 |

FOREIGN PATENT DOCUMENTS

GB 1344568 A * 1/1974

* cited by examiner

*Primary Examiner* — Robert B Davis

(74) *Attorney, Agent, or Firm* — Fraser Clemens Martin & Miller LLC; James D. Miller

(57) ABSTRACT

An apparatus includes an elongate shaft, a first paddle including a connecting member disposed generally parallel to the shaft and a cross member disposed generally perpendicular to the shaft and coupled thereto, wherein the connecting member includes at least one notch formed along an edge thereof, and a second paddle including a connecting member disposed generally parallel to the shaft and a cross member disposed generally perpendicular to the shaft and coupled thereto, wherein the connecting member includes at least one notch formed along an edge thereof.

18 Claims, 4 Drawing Sheets

ERGONOMIC PORTABLE MIXING APPARATUS

CROSS-REFERENCE TO RELATED APPLICATION

The present application is entitled to claim the benefit of, and claims priority to, U.S. provisional patent application Ser. No. 61/338,958 filed Feb. 26, 2010, the entire disclosure of which is incorporated herein by reference.

FIELD OF THE INVENTION

The present invention relates generally to a mixing apparatus. In particular, the invention is directed to an ergonomic, portable mixing apparatus.

BACKGROUND OF THE INVENTION

Currently, there are many applications for cement and concrete in most areas of construction. Since cement sets very quickly once water is added, batches typically must be mixed on site. For very small amounts of cement, manual labor (i.e. trowel and shovel) can be relied upon for mixing. Conversely, for relatively large amounts of cement, one can more economically purchase truckloads of a mixture which are delivered to the site in cement trucks. However, for the amounts between these extremes, mixing cement is not an easy, efficient task.

For example, a rotatable motor-driven container having an opening may be filled with a cement mix and water. After mixing, the container can be tilted for pouring a mixed cement into forms or for emptying the contents of the container into other containers for carrying to the desired location at a work site. A typical total mixing time for 240 pounds of cement in such rotatable containers is about 15 minutes and the cleanup of the container is both time consuming and messy.

As another example, an attachment-type mixer having a shaft can be coupled to a power drill for mixing a batch of cement. However, one problem with the attachment-type mixers currently available is that the shafts are short relative to a height of an operator. The short shaft of the attachment-type mixer forces the operator to bend over a container while mixing. Such a bending motion places strain on the lower back of the operator and positions a face of the operator within a "splash area" of the material being mixed. Accordingly, the use of conventional attachment-type mixers can result in splashing a caustic material into the face of the operator.

It is well documented by Occupational Safety and Health Administration (OSHA) and other entities that construction workers suffer a high incidence of injuries to the lower back, eyes, and face. Many of these injuries occur while mixing drywall and other alkali/caustic materials in buckets with attachment-type mixers coupled to hand-held power drills.

Another problem with conventional attachment-type mixers is that the attachment-type mixer is not anchored to a static base. Accordingly, the attachment-type mixers typically bounce around and have erratic movement during a mixing operation. Additionally, a container holding the material to be mixed can also be caused to move and spin due to the rotation of the attachment-type mixer.

Furthermore, it is understood that colloid materials such as cement tend to have a high viscosity. Accordingly, using the conventional attachment-type mixers with a hand-held drill can cause the drill motor to overheat and may lead to premature and permanent failure.

The shortcomings of the prior art can also result in incomplete and inconsistent mixing of the material to be mixed. Incomplete mixing requires the operator to manual mix the material or repeat a mixing operation, wasting time and material. In industrial processes, incomplete and inconsistent mixing leads to production delays, product defects, wasted energy and safety issues.

It would be desirable to provide a cost-efficient mixing device that mixes a material in a substantially uniform and consistent manner while minimizing a force required to operate the mixing device.

SUMMARY OF THE INVENTION

Concordant and consistent with the present invention, a cost-efficient mixing device that mixes a material to form a substantially uniform and consistent mixture, while minimizing a force required to operate the mixing device, has surprisingly been discovered.

In one embodiment, an apparatus comprises: an elongate shaft; a first paddle including a connecting member disposed generally parallel to the shaft and a cross member disposed generally perpendicular to the shaft and coupled thereto, wherein the connecting member includes at least one notch formed along an edge thereof; and a second paddle including a connecting member disposed generally parallel to the shaft and a cross member disposed generally perpendicular to the shaft and coupled thereto, wherein the connecting member includes at least one notch formed along an edge thereof.

In another embodiment, an apparatus comprises: an elongate shaft; a first paddle including a connecting member disposed generally parallel to the shaft and a pair of cross members disposed generally perpendicular to the shaft and coupled to the shaft to define a first aperture, wherein the connecting member includes at least one notch formed along an outer peripheral edge thereof; and a second paddle including a connecting member disposed generally parallel to the shaft and a cross member disposed generally perpendicular to the shaft and coupled to one end of the connecting member and the shaft to define a second aperture, wherein the connecting member includes at least one notch formed along an outer peripheral edge thereof.

In yet another embodiment, an apparatus comprises: a shaft; a first paddle including a connecting member disposed generally parallel to the shaft and a pair of cross members disposed generally perpendicular to the shaft and coupled to the shaft to define a first aperture, a first one of the cross members disposed adjacent an end of the shaft, wherein the connecting member includes at least one notch formed along an outer peripheral edge thereof; a second paddle including a connecting member disposed generally parallel to the shaft and a cross member disposed generally perpendicular to the shaft and coupled to one end of the connecting member and the shaft, wherein the connecting member includes at least one notch formed along an outer peripheral edge thereof; a third paddle including a connecting member disposed generally parallel to the shaft and a pair of cross members disposed generally perpendicular to the shaft and coupled to the shaft to define a second aperture, a first one of the cross members disposed adjacent an end of the shaft wherein the connecting member includes at least one notch formed along an outer peripheral edge thereof; and a fourth paddle including a connecting member disposed generally parallel to the shaft and a cross member disposed generally perpendicular to the shaft and coupled to one end of the connecting member and the shaft, wherein the connecting member includes at least one notch formed along an outer peripheral edge thereof.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner.

Figure 1:
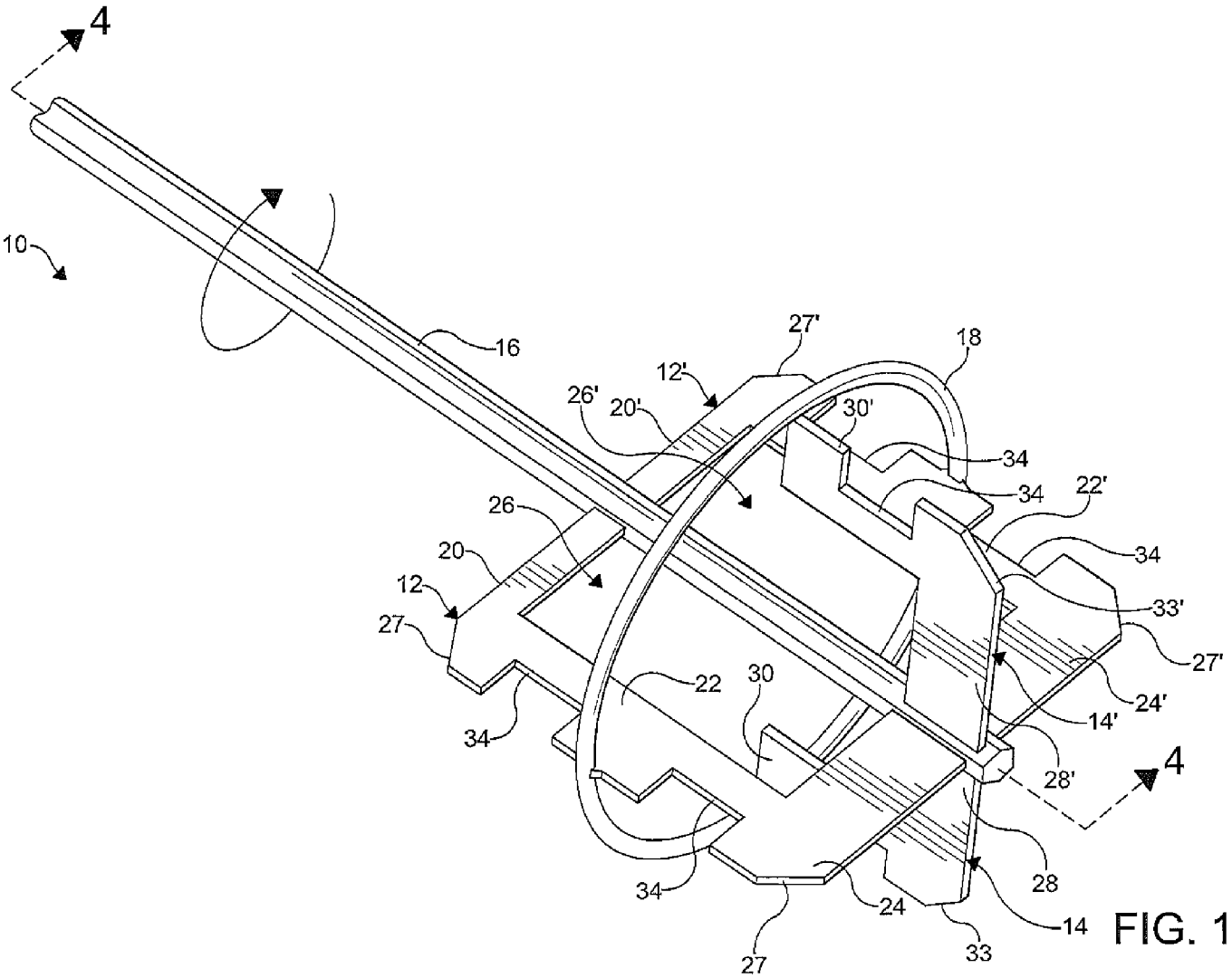
FIG. 1 is a bottom perspective view of a mixing apparatus according to an embodiment of the present invention.
Figure 2:
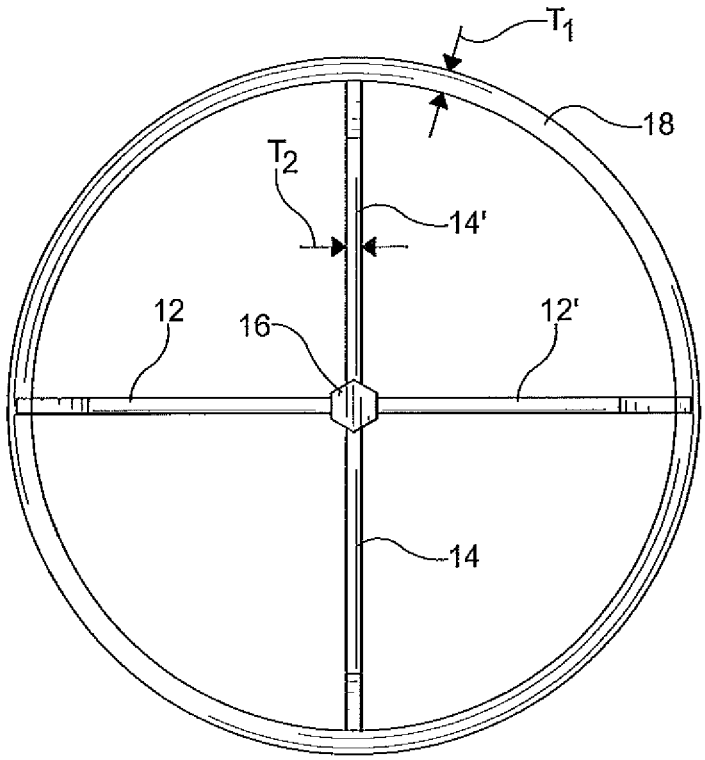
FIG. 2 is a bottom plan view of the mixing apparatus of FIG. 1.
Figure 3:
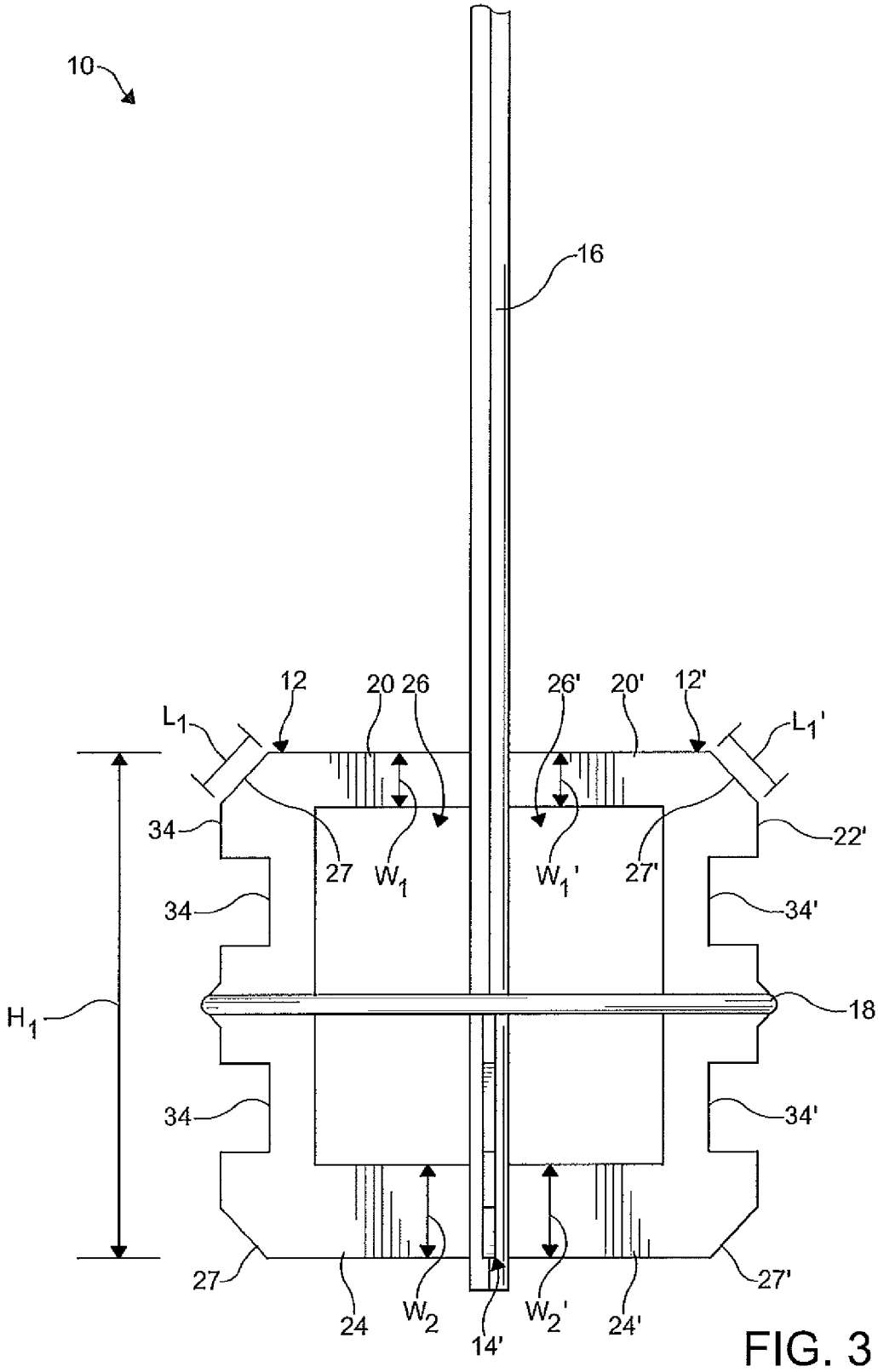
FIG. 3 is a side elevational view of the mixing apparatus of FIG. 1.
Figure 4:
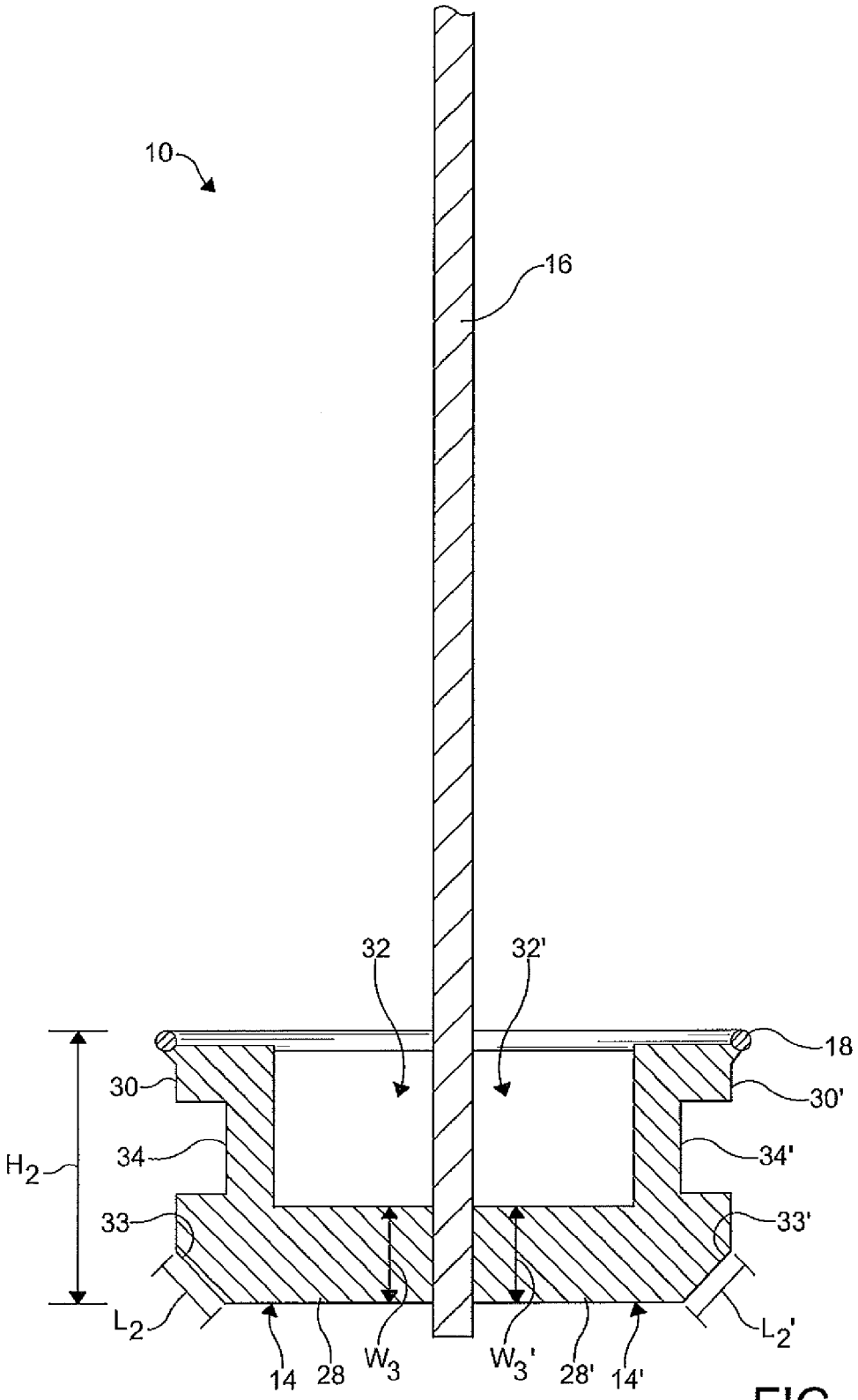
FIG. 4 is a cross-sectional elevational view of the mixing apparatus of FIG. 1 taken along line 4-4 shown in FIG. 1.

FIGS. 1-4 illustrate a mixing device 10 according to an embodiment of the present invention. The mixing device 10 includes a plurality of paddles 12, 12', 14, 14' coupled to an elongate shaft 16 and extending generally radially outwardly therefrom. The mixing device 10 can be constructed of steel, aluminum, plastic or other suitable material such as composites depending upon a material being mixed. Although four of the paddles 12, 12', 14, 14' are shown, the mixing device 10 can be constructed with any number of paddles or blades. As a non-limiting example, the mixing device 10 can be coupled to a power drill to impart rotational motion to the mixing device 10. However, it is understood that the mixing device 10 can be integrated into any mixing system, mixing chamber, or mixing method. It is further understood that the mixing device 10 can include additional components such as a stabilizing ring 18 or safety ring, which will be discussed in more detail hereinbelow.

The paddle 12 has a generally "C" shaped main body with a first cross member 20, a connecting member 22, and a second cross member 24. Each of the cross members 20, 24 of the paddle 12 is generally perpendicular to the shaft 16 and coupled thereto to define a first aperture 26. In such a configuration, the connecting member 22 is generally parallel to the shaft 16. As a non-limiting example, the first cross member 20 has a width $W_1$ that is less than a width $W_2$ of the second cross member 24. As a further non-limiting example, the main body of the paddle 12 can include at least one angled portion 27 formed adjacent a juncture of at least one of the cross members 20, 24 and the connecting member 22. In certain embodiments, the angled portion 27 has a length $L_1$ greater than or equal to the width $W_1$, $W_2$ of a respective one of the cross members 20, 24. However, the angled portion 27 can have any length, shape, and contour.

The paddle 12' has a generally "C" shaped main body with a first cross member 20', a connecting member 22', and a second cross member 24'. Each of the cross members 20', 24' of the paddle 12' is generally perpendicular to the shaft 16. Each of the cross members 20', 24' is coupled to the shaft 16 opposite to and in substantial alignment with the paddle 12 to define a second aperture 26'. In such a configuration, the connecting member 22' is generally parallel to the shaft 16. As a non-limiting example, the first cross member 20' has a width $W_1'$ that is less than a width $W_2'$ of the second cross member 24'. As a further non-limiting example, each of the paddles 12, 12' has substantially the same size and shape. However, it is understood that the paddles 12, 12' can have any shape and size. In the embodiment shown, the main body of the paddle 12' includes at least one angled portion 27' formed adjacent a juncture of at least one of the cross members 20', 24' and the connecting member 22'. In certain embodiments, the angled portion 27' has a length $L_1'$ greater than or equal to the width $W_1'$, $W_2'$ of a respective one of the cross members 20', 24'. However, the angled portion 27' can have any length, shape, and contour.

The paddle 14 has a generally "L" shaped main body with a cross member 28 and a connecting member 30. The cross member 28 of the paddle 14 is generally perpendicular to the shaft 16 and coupled thereto to define a third aperture 32. In such a configuration, the connecting member 30 is generally parallel to the shaft 16. As a non-limiting example, a width $W_3$ of the cross member 28 is the same as the width $W_2$, $W_2'$ of one of the second cross members 24, 24'. However, the cross member 28 of the paddle 14 can have any width. As a further non-limiting example, the main body of the paddle 14 can include at least one angled portion 33 formed adjacent a juncture of at least one of the cross member 28 and the connecting member 30. In certain embodiments, the angled portion 33 has a length $L_2$ at least equal to the width $W_3$ of the cross member 28. However, the angled portion 33 can have any length, shape, and contour.

The paddle 14' has a generally "L" shaped main body with a cross member 28' and a connecting member 30'. The cross member 28' of the paddle 14' is generally perpendicular to the shaft 16 and coupled thereto to define a fourth aperture 32'. In such a configuration, the connecting member 30' is generally parallel to the shaft 16. As a non-limiting example, a width $W_3'$ of the cross member 28' is the same as the width $W_2$, $W_2'$ of one of the second cross members 24, 24'. However, the cross member 28' of the paddle 14' can have any width. As a further non-limiting example, the main body of the paddle 14' can include at least one angled portion 33' formed adjacent a juncture of at least one of the cross member 28' and the connecting member 30'. In certain embodiments, the angled portion 33' has a length $L_2'$ at least equal to the width $W_3'$ of the cross member 28'. However, the angled portion 33' can have any length, shape, and contour.

In the embodiment shown, each of the paddles 14, 14' has substantially the same size and shape. As a further non-limiting example, each of the paddles 14, 14' has a planar surface area that is less than a planar surface area of each of the paddles 12, 12'. It is understood that the size, shape, and surface area of each the paddles 12, 12', 14, 14' can be varied to obtain optimal mixing performance. Favorable results have been achieved when a combined planar surface area of the paddles 14, 14' is between about 35.0 percent and about 70.0 percent of the combined planar surface area of the paddles 12, 12'. Favorable results have also been achieved when a maximum height $H_1$ of each of the paddles 12, 12' is greater than a maximum height $H_2$ of each of the paddles 14, 14'.

At least one notch 34 is formed in the main body of each of the paddles 12, 12', 14, 14'. As shown, each of the notches 34 has a generally rectangular shape. However, the notches 34 can have any size and shape. As a non-limiting example a pair of the notches 34 is formed along an outer edge of each of the connecting members 22, 22' of the paddles 12, 12'. As a further non-limiting example, one of the notches 34 is formed along an outer edge of each of the connecting members 30, 30' of the paddles 14, 14'. It is understood that each of the notches 34 can have the same or different sizes. It is further understood that a size of each of the notches 34 can be determined to maintain a desirable center of gravity (e.g. a low center of gravity to minimize vibration of the mixing device 10).

The shaft 16 is typically formed from ⅝-inch stock and may be releasably or permanently coupled to a drive means (not shown) such as a power drill by any conventional means of attachment (not shown) such as a drill chuck, for example. As shown, the shaft 16 has a hexagonal cross section to provide a stable coupling with the means of attachment. However, the shaft 16 can have any size and shape and can be formed from any suitable material having any diameter.

In certain embodiments, the stabilizing ring 18 or safety ring is concentrically disposed around the shaft 16 and coupled to a peripheral edge of each of the paddles 12, 12', 14, 14'. As a non-limiting example, the stabilizing ring 18 is coupled to an end of each of the connecting members 30, 30' of the paddles 14, 14'. As a further non-limiting example, the stabilizing ring 18 is coupled to the connection members 22, 22' of each of the paddles 12, 12' and disposed between the notches 34 formed in the connection members 22, 22' of each of the paddles 12, 12'. In certain embodiments, the stabilizing ring 18 has a thickness $T_1$ (i.e. diameter) that is greater than a thickness $T_2$ of a material used to form the paddles 12, 12', 14, 14'. However, it is understood that the stabilizing ring 18 can have any size, shape, and configuration relative to the paddles 12, 12', 14, 14'.

In use, the shaft 16 is coupled to the drive means (e.g. power drill, motor, drive shaft, and the like), wherein the paddles 12, 12', 14, 14' are spaced from the drive means. The paddles 12, 12', 14, 14' are immersed in a material to be mixed (not shown) such as cement, for example. The drive means is activated in order to cause the shaft 16 to rotate. As the shaft 16 rotates, the paddles 12, 12', 14, 14' displace the material to be mixed. Accordingly, the material to be mixed is caused to flow through the notches 34 and the apertures 26, 26', 32, 32'. Specifically, the configuration of the paddles 12, 12', 14, 14' relative to each other along with the position of the notches 34 along an outer periphery of the mixing device 10 generates a plurality of generally horizontal vortexes in the material to be mixed. Additionally, a differential in the height H1 of the paddles 12, 12' relative to the height H2 of the paddles 14, 14' causes the material to be mixed to flow from the first cross members 20, 20' of the paddles 12, 12' along the shaft 16 toward the second cross members 24, 24' of the paddles 12, 12'. The second cross members 24, 24' of the paddles 12, 12' and the cross members 28, 28' of the paddles 14, 14' cause the material to be mixed to flow radially outwardly from the shaft.

Since the width $W_1$, $W_1'$ of the first cross members of each of the paddles 12, 12' is less than the width $W_2$, $W_2'$ of the second cross members 24, 24' of each of the paddles 12, 12', a center of gravity of the mixing device is located below a center point along the height H1 of the paddles 12, 12'. Furthermore, since the notches 34 are formed along an outer edge of each of the connecting members 22, 22', 30, 30' a force (i.e. torque on the shaft 16) required to rotate the paddles 12, 12', 14, 14' in the material to be mixed is minimized while causing a dynamic and turbulent flow of the material to be mixed.

The mixing device 10 provides a cost-efficient means to mix a material into a substantially uniform and consistent mixture, while minimizing a force required to operate the mixing device 10. The mixing device 10 minimizes a total energy required to sufficiently mix a colloid material on a construction site and in industrial processes. Specifically, a peak load placed upon the drive means causing the shaft 16 to rotate is minimized, thereby militating against an overheating condition.

The paddles 12, 12', 14, 14' of the mixing device 10 and the notches 34 formed therein can be configured in a variety of sizes and positions to optimize a mixing procedure for a specific material.

The mixing device 10 of the present invention can be operated be in a clockwise or counter clockwise rotation, thereby maximizing adaptability to use in existing industrial processes.

The mixing device 10 of the present invention not only entrains colloid materials, but can cause materials to move through a mixing chamber in a controlled and systematic manner.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. An apparatus comprising:

an elongate shaft;

a first paddle including a connecting member disposed generally parallel to the shaft and a cross member disposed generally perpendicular to the shaft and coupled thereto, wherein the connecting member includes at least one notch formed along an edge thereof, wherein the first paddle includes an angled portion formed at a juncture between the connecting member of the first paddle and the cross member of the first paddle; and a second paddle including a connecting member disposed generally parallel to the shaft and a cross member disposed generally perpendicular to the shaft and coupled thereto, wherein the connecting member includes at least one notch formed along an edge thereof.

2. The apparatus according to claim 1, wherein the elongate shaft has a hexagonal cross sectional shape.

3. The apparatus according to claim 1, wherein at least one of the first paddle and the second paddle has a generally "L" shaped main body defined by the connecting member and the cross member of the at least one of the first paddle and the second paddle.

4. The apparatus according to claim 1, wherein the second paddle includes an angled portion formed at a juncture between the connecting member of the second paddle and the cross member of the second paddle.

5. The apparatus according to claim 1, wherein the cross member of at least one of the first paddle and the second paddle is disposed adjacent an end of the shaft.

6. An apparatus comprising:

an elongate shaft;

a first paddle including a connecting member disposed generally parallel to the shaft and a pair of cross members disposed generally perpendicular to the shaft and coupled to the shaft to define a first aperture, wherein the connecting member includes at least one notch formed along an outer peripheral edge thereof; and a second paddle including a connecting member disposed generally parallel to the shaft and a cross member disposed generally perpendicular to the shaft and coupled to one end of the connecting member and the shaft to define a second aperture, wherein the connecting member includes at least one notch formed along an outer peripheral edge thereof, wherein an overall height of the first paddle is greater than an overall height of the second paddle.

7. The apparatus according to claim 6, wherein the first paddle has a generally "C" shaped main body defined by the connecting member and the cross members of the first paddle.

8. The apparatus according to claim 6, wherein the first paddle includes an angled portion formed at a juncture between the connecting member of the first paddle and at least one of the cross members of the first paddle.

9. The apparatus according to claim 6, wherein the second paddle has a generally "L" shaped main body defined by the connecting member and the cross member of the second paddle.

10. The apparatus according to claim 6, wherein the second paddle includes an angled portion formed at a juncture between the connecting member of the second paddle and the cross member of the second paddle.

11. The apparatus according to claim 6, wherein a first one of the cross members of the first paddle is disposed adjacent an end of the shaft and a second one of the cross members of the first paddle is spaced from the first one of the cross members of the first paddle.

12. The apparatus according to claim 11, wherein a width of the first one of the cross members of the first paddle is greater than a width of the second one of the cross members of the first paddle.

13. The apparatus according to claim 6, further comprising a stabilizing ring concentrically disposed around the shaft and coupled to an outer periphery of the first paddle and the second paddle.

14. The apparatus according to claim 13, wherein a thickness of the stabilizing ring is at least equal to a thickness of at least one of the first paddle and the second paddle.

15. An apparatus comprising:

a shaft;

a first paddle including a connecting member disposed generally parallel to the shaft and a pair of cross members disposed generally perpendicular to the shaft and coupled to the shaft to define a first aperture, a first one of the cross members disposed adjacent an end of the shaft, wherein the connecting member includes at least one notch formed along an outer peripheral edge thereof;

a second paddle including a connecting member disposed generally parallel to the shaft and a cross member disposed generally perpendicular to the shaft and coupled to one end of the connecting member and the shaft, wherein the connecting member includes at least one notch formed along an outer peripheral edge thereof;

a third paddle including a connecting member disposed generally parallel to the shaft and a pair of cross members disposed generally perpendicular to the shaft and coupled to the shaft to define a second aperture, a first one of the cross members disposed adjacent an end of the shaft wherein the connecting member includes at least one notch formed along an outer peripheral edge thereof; and a fourth paddle including a connecting member disposed generally parallel to the shaft and a cross member disposed generally perpendicular to the shaft and coupled to one end of the connecting member and the shaft, wherein the connecting member includes at least one notch formed along an outer peripheral edge thereof.

16. The apparatus according to claim 15, wherein a width of the first one of the cross members of the first paddle is greater than a width of a second one of the cross members of the first paddle and a width of the first one of the cross members of the third paddle is greater than a width of a second one of the cross members of the third paddle.

17. The apparatus according to claim 15, wherein a combined planar surface area of the second paddle and the fourth paddle is between about 35.0 percent and about 70.0 percent of the combined planar surface area of the first paddle and the third paddle.

18. The apparatus according to claim 15, further comprising a stabilizing ring concentrically disposed around the shaft and coupled to an outer periphery of at least one of the paddles, wherein the stabilizing ring is coupled to the connecting members of each of the second paddle and the fourth paddle, the stabilizing ring cooperating with the second paddle and the fourth paddle to define a third aperture and a fourth aperture.

* * * * *